US005241706A

United States Patent [19]

Netz

[11] Patent Number: 5,241,706

[45] Date of Patent: Sep. 7, 1993

[54] GARMENT CONVERTIBLE FROM MUFFLER TO SEAT WARMER

[75] Inventor: James F. Netz, Pence, Wis.

[73] Assignee: Netz Glove Company Inc., Pence, Wis.

[21] Appl. No.: 959,387

[22] Filed: Oct. 13, 1992

[51] Int. Cl.[5] ..... A41D 5/00

[52] U.S. Cl. ..... 2/66; 2/91; 2/46; 2/267

[58] Field of Search ..... 2/1, 2, 16, 46, 48, 2/66, 91, 94, 267, 208

[56] References Cited

U.S. PATENT DOCUMENTS

| | | | |
|---|---|---|---|
| 2,446,006 | 7/1948 | Hendricks | 2/2 |
| 2,557,280 | 6/1951 | Hahn . | |
| 2,835,896 | 5/1958 | Giese . | |
| 3,185,362 | 5/1965 | Wakefield | 2/24 |
| 3,708,799 | 1/1973 | Smithdeal | 2/46 |
| 4,459,703 | 7/1984 | Kosmas et al. | 2/48 |
| 4,495,659 | 1/1985 | Madnick et al. . | |
| 4,689,829 | 9/1987 | Kaplan | 2/46 |
| 4,735,423 | 4/1988 | Foss | 2/46 |
| 4,837,859 | 6/1989 | Hamberg | 2/44 |
| 4,862,519 | 9/1989 | Bull . | |
| 4,949,887 | 8/1990 | Holmes . | |

OTHER PUBLICATIONS

"Rear Gear" Advertising Brochure, Ins-Tent Mfg. Co., Cloquet, Minn. (Date unknown).

*Primary Examiner*—Clifford D. Crowder
*Assistant Examiner*—Gloria Hale
*Attorney, Agent, or Firm*—Nilles & Nilles

[57] ABSTRACT

A garment includes a foldable pad which can be unfolded, worn about the waist of the user, and worn over and below the rear or buttocks of the user, thereby serving as a seat. The pad can also be folded and secured in its folded state to define a space within for receiving the hands of the user, strapped to the waist of the user, and worn in front of the user, thus serving as a muffler. The pad is preferably composed of three adjacent pads joined to one another to facilitate folding. The pad is preferably insulated and constructed out of a waterproof material, thus permitting its use under a wide variety of weather conditions.

13 Claims, 5 Drawing Sheets

GARMENT CONVERTIBLE FROM MUFFLER TO SEAT WARMER

BACKGROUND OF THE INVENTION

1. Field of the Invention

The invention relates to convertible garments and, more particularly, relates to a garment which is convertible from a seat warmer to a muffler.

2. Discussion of the Related Art

It is often desirable during hunting, hiking, viewing sporting events, fishing, etc. to wear garments or to carry articles which keep various parts of the body warm and dry. Protection of the user's hands and seat or buttocks is often of particular concern, especially when the user expects to spend prolonged periods of time remaining stationary in a cold or wet environment. However, practical considerations such as space and weight constraints often prevent one from carrying both a muffler and a seat warmer on such excursions.

Devices have been proposed which attempt to eliminate the need for carrying separate muffler and seat cushions at the same time. One such device is disclosed in U.S. Pat. No. 4,949,887, which issued to Holmes on Aug. 21, 1990. This device includes an insulated hollow cushion having a neck strap allowing the cushion to be worn about the user's neck. The cushion can be used as a muffler by opening flaps on the side of the cushion and by inserting one's hands into openings exposed by the open flaps. The device can also be used as a seat cushion but only after removing it from the neck of the user and after setting it on the ground.

While the cushioned article discussed above may eliminate the need for a separate muffler and seat warmer, it exhibits several disadvantages. It is insufficiently long to function as a seat cushion when it is worn by the user but instead must be physically removed from the user's body and set upon the ground. The danger then arises that the user will forget the article when he or she moves to another location. The device also has many flaps and compartments and is thus rather expensive to manufacture. It is also designed to be worn about the neck and thus may be rather uncomfortable, even when it is not in use.

OBJECTS AND SUMMARY OF THE INVENTION

It is therefore an object of the invention to provide a garment which is easily convertible from a seat warmer to a muffler.

Another object of the invention is to provide a convertible garment which can be worn about the user's waist when it is being used as either a seat warmer or a muffler.

Still another object of the invention to provide a convertible garment which is simple and inexpensive to manufacture.

In accordance with these and other objects, a convertible garment is provided comprising a foldable pad which can be unfolded, worn about the waist of a user, and worn over and below the buttocks of the user, thereby serving as a seat. The garment can also be folded and secured in a folded position to define a space therein for receiving the hands of the user strapped about the waist of the user, and worn in front of the user, thereby serving as a muffler.

To facilitate folding and to minimize expense, the foldable pad preferably includes a first section having upper and lower edges, a second section having an upper edge joined to the lower edge of the first section and having a lower edge, and a third section having an upper edge joined to a lower edge of the second section and having a lower edge. To further facilitate folding, devices such as seams are preferably provided between the first and second and the second and third sections. The first and second sections are preferably of substantially the same length, and the third section is preferably shorter than either of the first and second sections.

Other objects, features and advantages of the present invention will become apparent to those skilled in the art from the following detailed description. It should be understood, however, that the detailed description and specific examples, while indicating preferred embodiments of the present invention, are given by way of illustration and not of limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from a detailed description to follow, reference being made to the accompanying drawings in which like reference numerals represent like parts throughout, and in which.

DETAILED DESCRIPTION OF THE PREFERRED EMBODIMENTS

Figure 1:
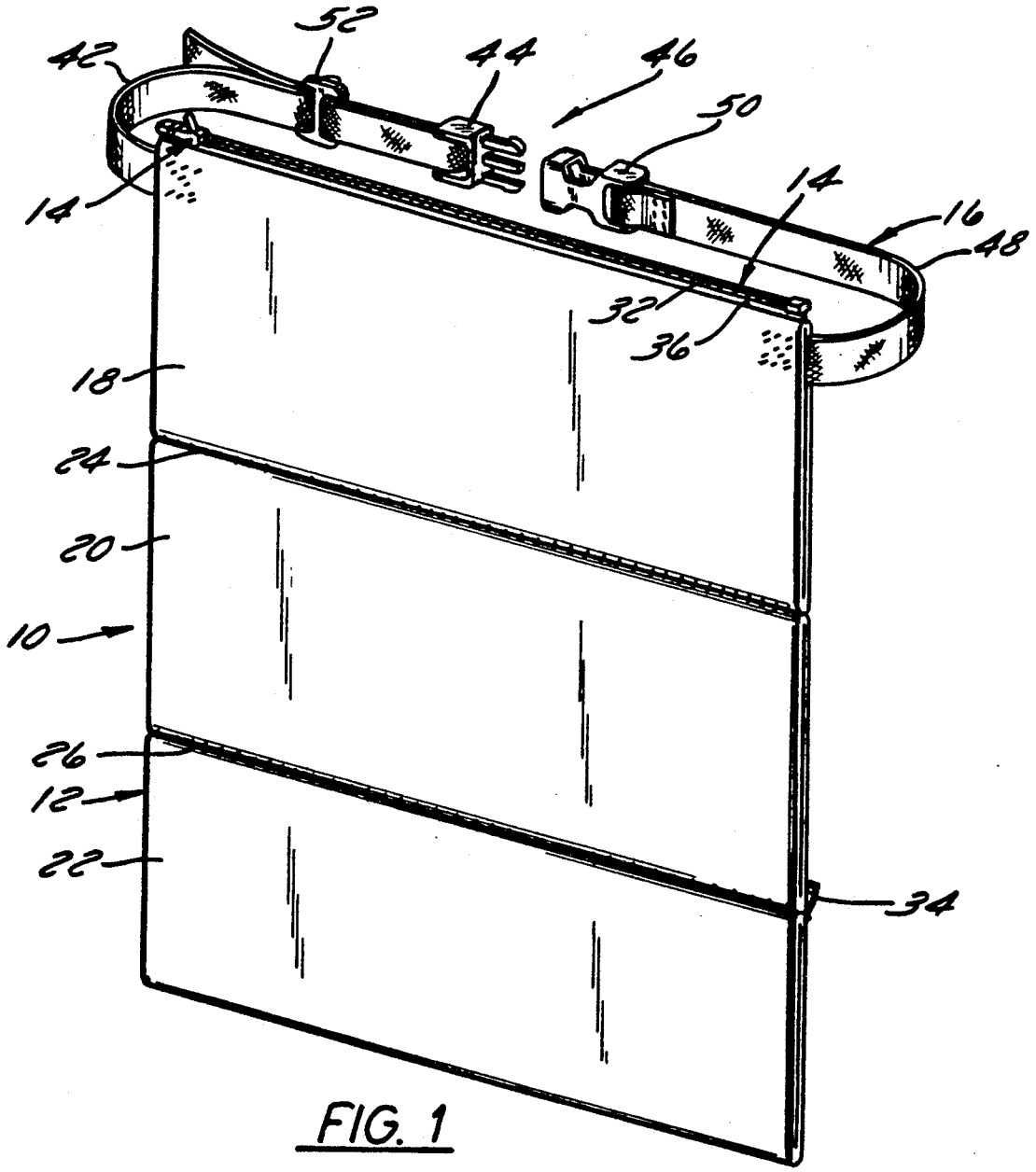
FIG. 1 is a perspective view of the front face of a convertible garment constructed in accordance with the present invention in which the garment is in its completely unfolded state.

Pursuant to the invention, a garment is provided comprising a foldable pad which can be unfolded, worn about the waist of the user, and worn over and below the rear or buttocks of the user, thereby serving as a seat. The pad can also be folded and secured in its folded state to define a space within for receiving the hands of the user, strapped to the waist of the user, and worn in front of the user, thus serving as a muffler. The pad is preferably composed of three adjacent pads joined to one another to facilitate folding. The pad is preferably insulated and constructed out of a waterproof material, thus permitting its use under a wide variety of weather conditions.

Referring to the drawings, a convertible garment 10 constructed in accordance with the present invention includes a foldable pad 12, a fastener 14 for securing the garment in its folded state, and a strap 16 for strapping the garment onto the body of the wearer.

The foldable pad 12 preferably includes first, second and third sections 18, 20 and 22 having adjacent edges joined at seams 24 and 26. Pad 12 is foldable from its fully unfolded state or position illustrated in FIGS. 1 and 6 through the partially folded state illustrated in FIG. 2 to the fully folded position illustrated in FIGS. 3–5.

Figure 5:
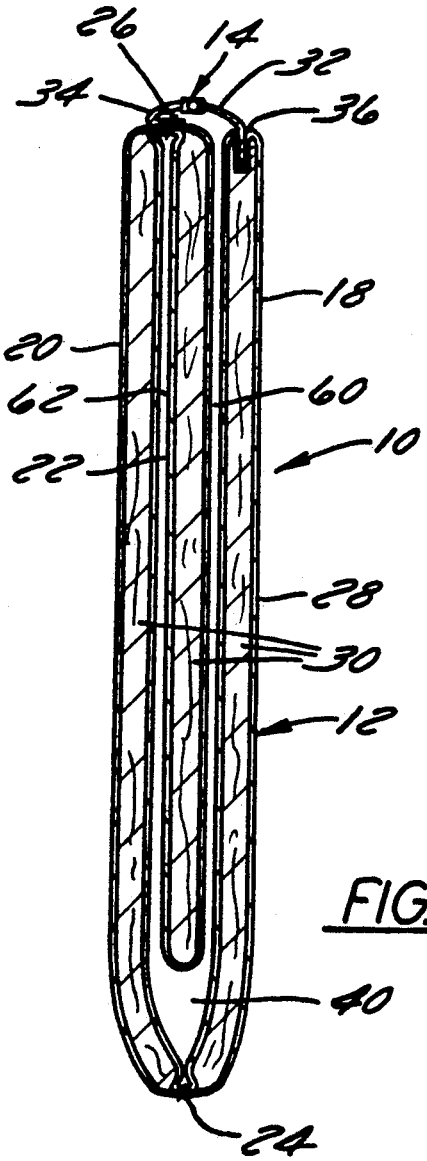
FIG. 5 is a sectional view taken along the lines 5—5 in FIG. 4.
Figure 6:
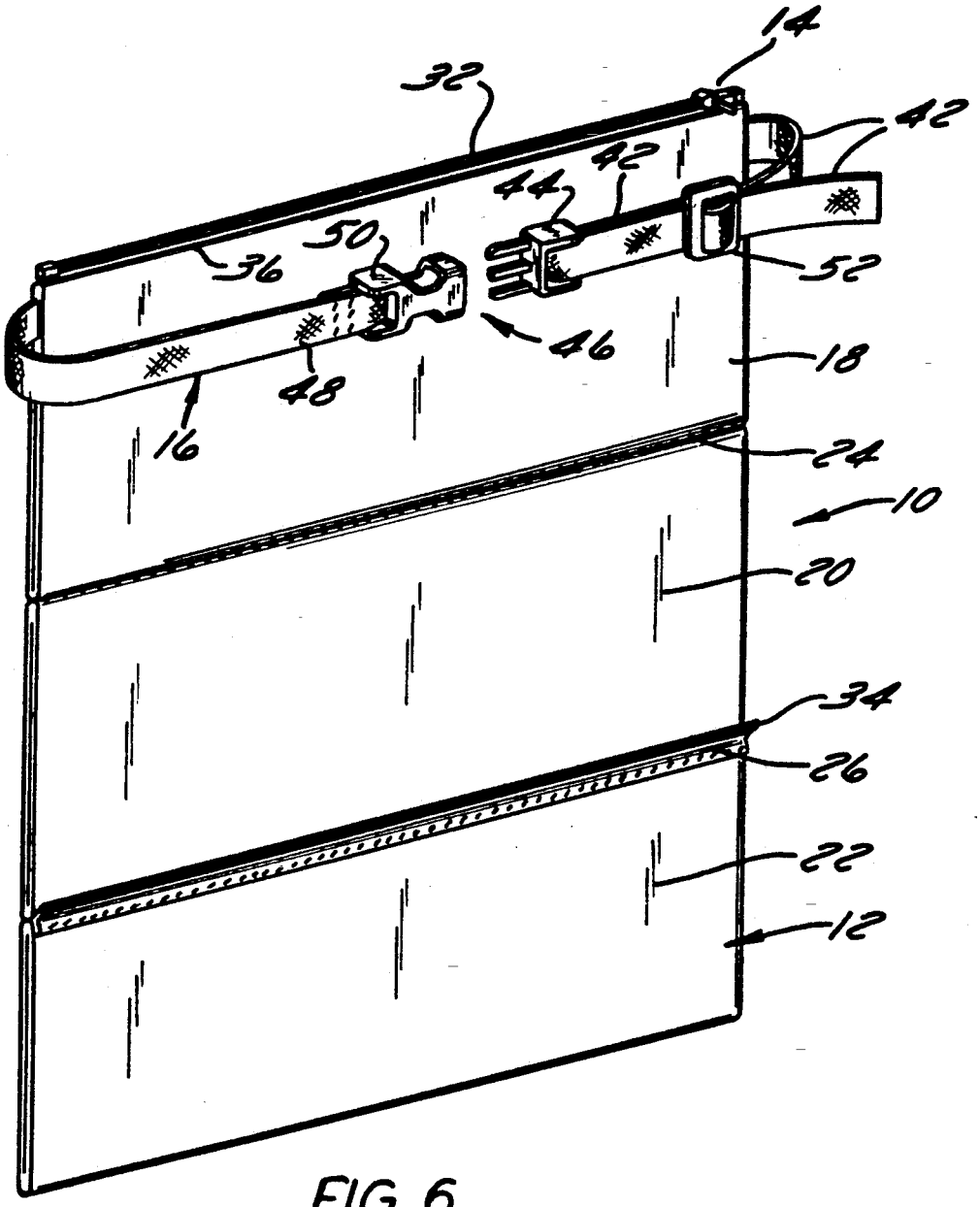
FIG. 6 is a perspective view of the convertible garment of FIGS. 1–5 in its unfolded state, viewed from the rear face of the garment.

In the illustrated embodiment, the sections 18, 20, and 22 of pad 12 are formed from a single envelope with its lateral edges and longitudinal ends sewn together and with the seams 24 and 26 defining the boundaries between the individual sections. Pad 12 could be constructed out of any suitable material, but is preferably constructed of a relatively soft, flexible material which maximizes wearer comfort while being durable and resistant to soiling or water seepage. Referring to FIG. 5, the pad may be formed from a shell 28 of a water resistant or preferably waterproof material such as waterproof nylon. The shell is preferably padded with a cushion material 30 having good insulation properties. The fibrous material manufactured by 3M Company and sold under the trade name THINSULATE is preferred for its ability to provide a high amount of insulation in a relatively small space.

The fastener 14 for securing the foldable body 12 in its completely folded position preferably comprises a zipper formed from first and second mating portions 32, 34. First portion 32 of zipper 14 is fastened to the upper edge 36 of the first section 18 of foldable pad 12. The second portion 34 of zipper 14 is sewn to the border between pad sections 20 and 22 such that the lines of stitching connecting second portion 34 of zipper 14 to the pad 12 form seam 26. The portions 32 and 34 of zipper 14 are positioned so as to mate with one another when the pad 12 is folded to the position illustrated in FIGS. 3–5.

Figure 3:
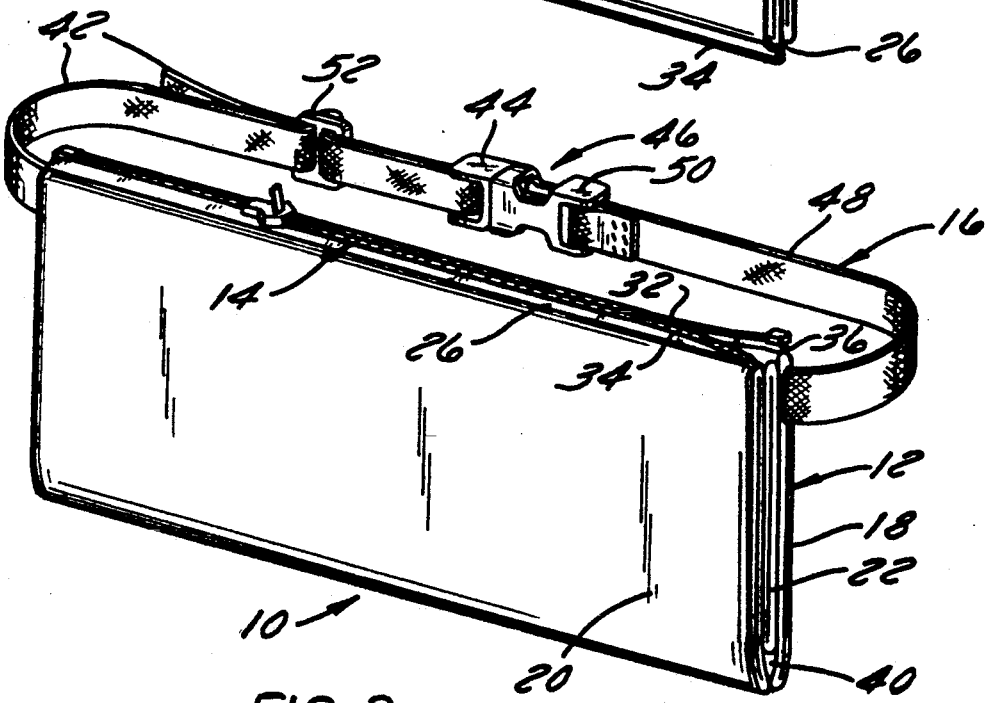
FIG. 3 is a perspective view of the convertible garment of FIGS. 1 and 2 in its fully folded state and with its fastener partially closed.
Figure 4:
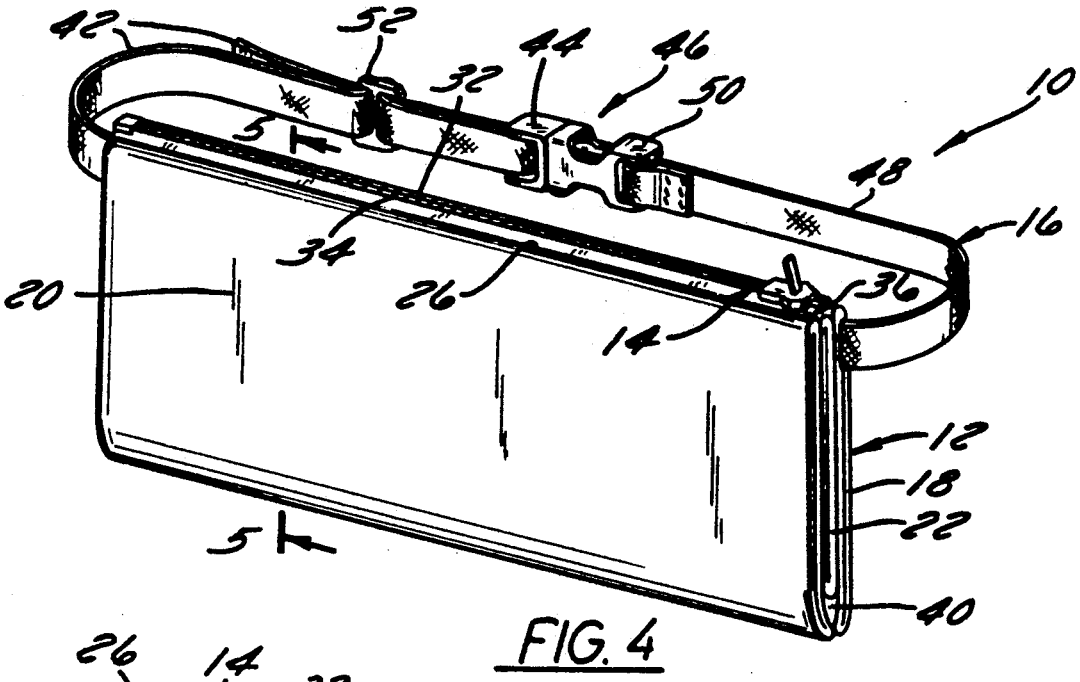
FIG. 4 is a perspective view of the convertible garment of FIG. 3 with the fastener fully closed.

Folding of the pad 12 and alignment the zipper portions 32, 34 is facilitated by providing the seams 24 and 26 which form as fold points, and by designing the third section 22 of pad 12 to be slightly shorter than the sections 20 and 18 so that a gap 40 is formed between the free end of third section 22 and the seam 24 between first and second sections 18 and 20 of foldable pad 12 when the pad is in its fully folded position illustrated in FIGS. 3–5. This gap prevents the third section 22 from interfering with the folding of the first and second sections 18 and 20 and thus prevents the pad 12 from bulging out at its lower end. First and second sections 18 and 20 are preferably of substantially the same length so that they extend generally parallel to third section 22 when the pad 12 is in its folded state.

Strap 16 is sewn or otherwise secured to the opposed lateral edge portions of first section 18 of foldable pad 12 near the upper edge 36 thereof. In the illustrated embodiment, the strap 16 is a simple two piece adjustable nylon strap. The first piece 42 is connected to the left edge of the first section 18 of pad 12 and terminates in a portion 44 of a buckle 46. The second piece 48 is connected to the right edge of the first section 18 of foldable pad 12 and terminates in a female portion 50 of buckle 46 which mates with the male portion 44. Strap 16 including buckle 46 is conventional and preferably includes a device such as a conventional loop fastener 52 for permitting adjustment of the length of the strap 16.

Figure 7:
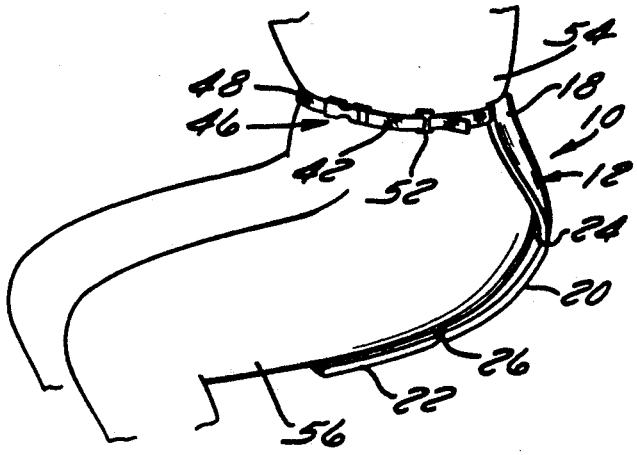
FIG. 7 illustrates the convertible garment of FIGS. 1–6 in use as a seat warmer.

To use the convertible garment as a seat cushion, the foldable pad is worn in its unfolded state so that it hangs over and below the buttocks or rear of the user. This is done simply by positioning the pad behind one's waist 54 and legs 56 such that the upper edge of first section 18 of foldable pad 12 and thus the strap 16 are positioned behind the waist 54 and over the buttocks of the wearer. The ends 42 and 48 of strap 16 are then looped around the front of the user and buckled together via buckle 46 as illustrated in FIG. 7. If necessary, the length of the strap 16 can be adjusted via loop fastener 52 so that the strap 16 fits snugly around the user's waist 54 so that the foldable pad 12 does not ride up and down the user's back. The garment 10 thus is usable as a seat which is worn on the user's body. This seat does not have to be removed or positioned for use but instead is flexible and thus bends with the user's waist 54 and legs 56 as he or she sits down so as to act as a cushion, and straightens out as he or she stands up so as not to interfere with normal walking. Since the pad 12 is waterproof and insulated, the wearer's comfort can be maintained even when he or she is sitting for prolonged periods of time on a damp and/or cold surface.

Figure 2:
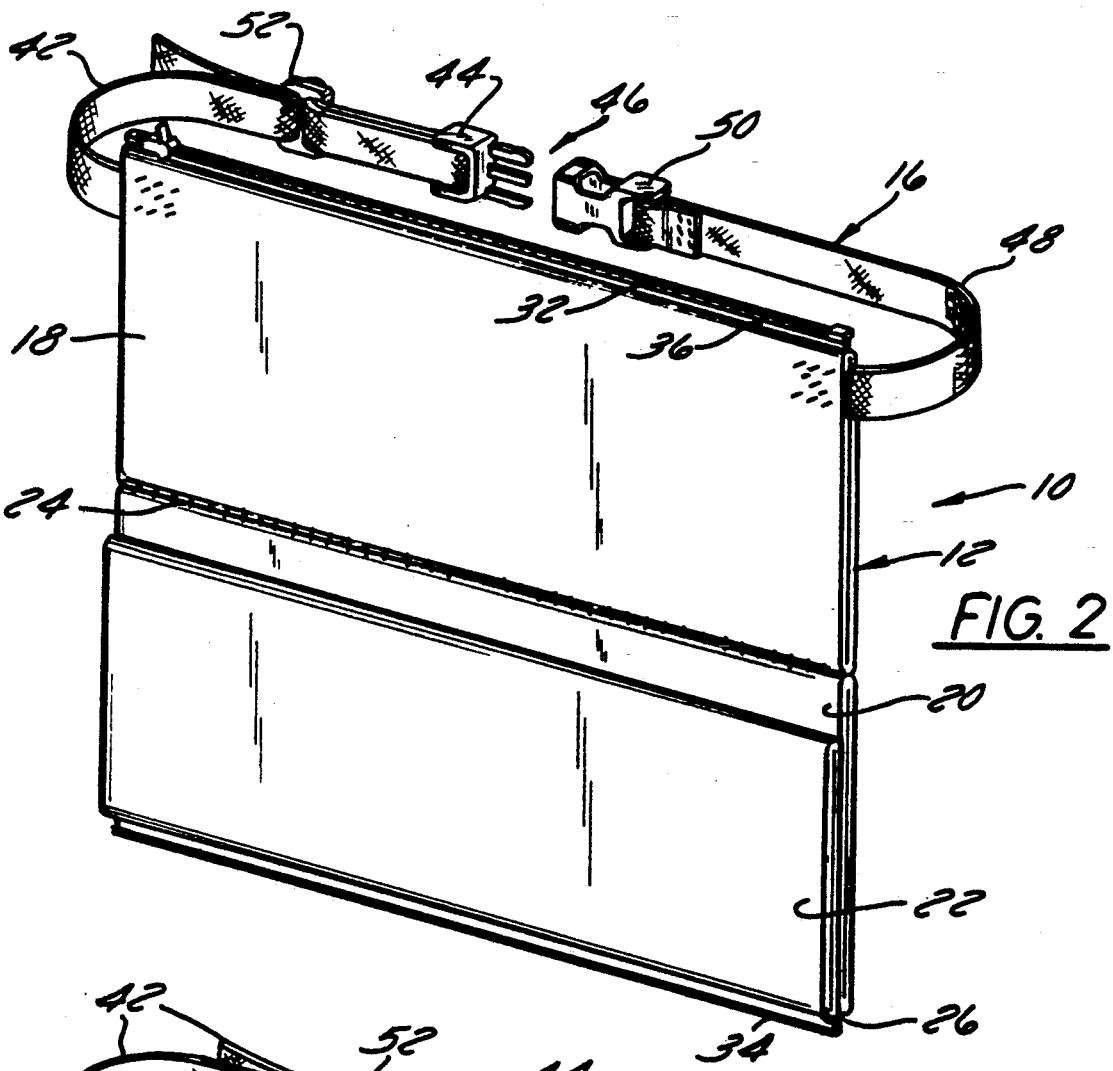
FIG. 2 is a perspective view of the convertible garment of FIG. 1 in which the garment is in a partially folded state.

To use the convertible garment as a muffler, the user first folds the third section 22 of foldable pad 12 about seam 26 upward and forward from the position illustrated in FIG. 1 onto the front face of second section 20 as illustrated in FIG. 2. Then, the second and third sections 20 and 22 are folded upwardly about seam 24 onto the front face of first section 18 to the position illustrated in FIG. 3 in which the portions 32 and 34 of zipper 14 are aligned with one another. The zipper 14 is then closed to secure the pad 12 in its folded position, thus forming a pair of generally tubular pockets 60, 62 (FIG. 5).

Figure 8:
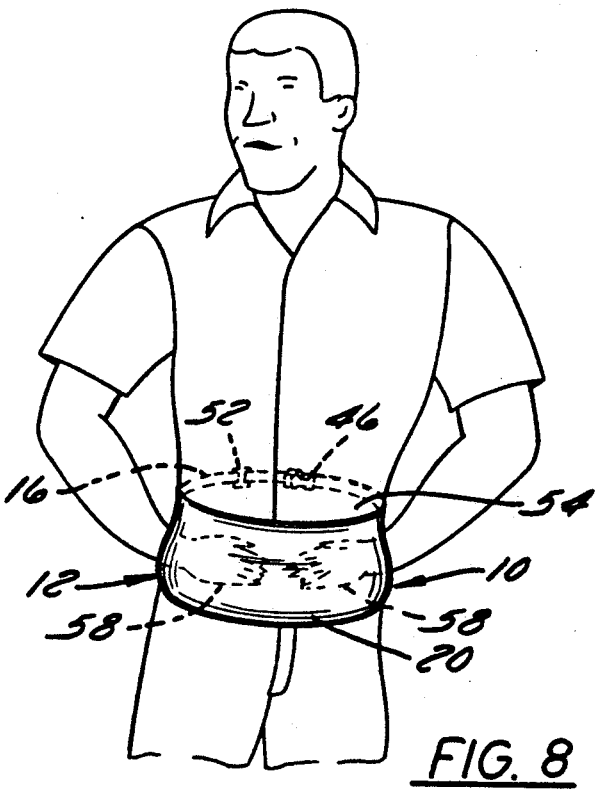
FIG. 8 illustrates the convertible garment of FIGS. 1–6 in use as a as a muffler.

Next, the folded pad 12 is positioned in front of the user's waist 54 and the pieces 42 and 48 of strap 16 are looped around the user's back and buckled to one another. He or she then simply inserts his o her hands 58 into the pockets formed by the folded sections pad of 12 as illustrated in FIG. 8, thus protecting his or her hands 58 from the elements. Both hands may be inserted into the same pocket 60 or 62, thus permitting the wearer to use the warmth of one hand to warm the other. Alternately, the wearer may insert each hand into a separate pocket, thus preventing contact between each of the wearer's hands and the sleeve of the opposite arm and keeping the wearer's hands dry when his or her sleeves are wet.

Since the garment 10 can be used as a muffler without providing pockets or flaps present in other such article, it easy to use and simple and relatively inexpensive to manufacture. Moreover, since garment 10 is designed to be worn about the user's waist rather than the neck, it is comfortable to wear.

Many modifications or changes could be made to the garment discussed above without departing from the spirit and scope of the present invention. For instance, the fastener 14 need not comprise a zipper but could be formed from hook and loop members, snaps, or any other mating devices capable of securing the pad 12 in its folded position. Nor need this fastener be provided in the precise position illustrated. For example, portion 34 need not be located on the seam 26 between pad sections 20 and 22. In fact, in the illustrated embodiment, although the body of the zipper portion 34 is sewn to seam 24, the teeth are actually located slightly above the seam 24 on portion 34, thus facilitating connection of the pad sections.

Strap 16 including buckle 46 need not be constructed as illustrated but could be formed of any member enabling the pad 12 to be worn about the user's waist. Thus, the strap 16 could form a continuous belt which can be detached and adjustably connected at one of its ends to one of the other sides of the pad 12, or the buckle 46 could be replaced by snaps, hook and loop fasteners, or any other device capable of connecting the opposed ends of pieces 42 and 48 of strap 16 to one another. The strap could also be eliminated altogether and replaced by clips or other devices permitting the pad to be attached to the belt or waistband of the user.

Similarly, the sections 18, 20 and 22 of the pad 12 need not be integral as illustrated but could be formed of separate pads which are sewn to one another or connected to one another in any suitable manner to form a secure, though not necessarily permanent, connection. Two sections could also be provided instead of three. However, it is preferred that the pad be divided into three sections and that seams or some other devices facilitating folding be provided on the pad so that it may be easily folded onto itself as described above.

Other possible changes and modifications will become apparent when the scope of the present invention is more fully understood from the appended claims.

I claim:

1. A convertible garment comprising:

(A) a foldable pad including a first section having upper and lower edges, a second section having an upper edge joined to said lower edge of said first section and having a lower edge, and a third section having an upper edge joined to a lower edge of said second section and having a lower edge;

(B) a fastener including a first portion which is attached to said first section proximate said upper edge and a second portion which is attached to said pad proximate said upper edge of said third section and which mates with said first portion when said pad is folded from an unfolded state into a folded state in which said third section is folded onto said second section and said second and third sections are folded onto said first section such that said third section is sandwiched between said first and second sections, said first, second, and third sections and said fastener cooperating such that, when said pad is folded and fastened into said folded state, a pocket is formed between at least one of said first and third sections and said second and third sections which is sufficiently large to receive a wearer's hands, thus forming a muffler; and (c) a device, attached to said first section proximate said upper edge, for securing said garment about the waist of the wearer in both said folded and unfolded states.

2. A convertible garment according to claim 1, wherein said first, second, and third sections each comprises a cushioned pad which is joined to an adjacent pad at a seam which facilitates folding.

3. A convertible garment according to claim 2, wherein said first and second sections are of substantially the same length and said third section is shorter than each of said first and second sections.

4. A convertible garment according to claim 2, wherein each of said pads comprises an outer shell of a water resistant material and an inner layer of insulation.

5. A convertible garment according to claim 2, wherein said pads of said first, second, and third sections are formed integral with one another.

6. A convertible garment according to claim 1, wherein said device comprises a strap having first and second pieces, each of which has a first end attached to a respective lateral edge of said first section of said pad and a second end terminating in a strap fastener for connection to the other piece.

7. A convertible garment according to claim 6, wherein said strap fasteners comprise mating portions of a buckle.

8. A convertible garment according to claim 1, wherein said fastener portions comprise mating portions of a zipper.

9. A convertible garment according to claim 1, wherein said pad is sufficiently long that, in said unfolded state, it can be worn about the waist of said wearer so as to extend below the waist of the wearer so as to serve as a seat.

10. A convertible garment comprising:

a pad which includes a device for securing said pad about the waist of a person and which is sufficiently long to extend over and below the buttocks of said person when secured to said person's waist, thereby serving as a seat, said pad being foldable and having fasteners for securing said pad in a folded position, a space being defined in said pad when said pad is secured in said folded position, said space being sufficiently large to receive the hands of the user, thereby serving as a muffler, said pad including a first section having upper and lower edges, a second section having an upper edge joined to said lower edge of said first section and having a lower edge, and a third section having an upper edge joined to a lower edge of said second section and having a lower edge, wherein, when said pad is secured in said folded position, said third section is sandwiched between said first and second sections such that said space is formed between at least one of said first and third sections and said second and third sections.

11. The convertible garment according to claim 10, wherein said foldable pad includes a first section having upper and lower edges, a second section having an upper edge joined to said lower edge of said first section and having a lower edge, and a third section having an upper edge joined to a lower edge of said second section and having a lower edge.

12. The convertible garment according to claim 11, wherein devices facilitating folding are provided between said first and second sections and said second and third sections, said first and second sections are of substantially the same length, and said third section is shorter than either of said first and second sections.

13. A convertible garment comprising:

(A) a foldable pad including a first section having upper and lower edges, a second section having an upper edge joined to said lower edge of said first section and having a lower edge, and a third section having an upper edge joined to a lower edge of said second section and having a lower edge, said first and second section s being of substantially the same length and said third section being shorter than each of said first and second sections;

(B) a fastener including a first portion which is attached to said first section proximate said upper edge and a second portion which is attached to said pad proximate said upper edge third section and which mates with said first portion when said pad is folded from an unfolded state into a folded state in which said third section is folded onto said second section and said second and third sections are folded onto said first section such that said third section is sandwiched between said first and second sections, said first, second, and third sections and said fastener cooperating such that, when said pad is folded and fastened into said folded state, first and second pockets are formed between said first and third sections and said second and third sections, respectively, said first and second pockets being sufficiently large to receive a wearer's hands, thus forming a muffler; and (C) a strap having first and second pieces, each of which has a first end attached to a respective lateral edge of said first section of said pad proximate said upper edge and a second end terminating in a strap fastener for connection to the other piece, said strap being capable of securing said garment about the waist of the wearer in both said folded and unfolded states.

* * * * *